United States Patent [19]

McGowan

[11] 4,297,086

[45] Oct. 27, 1981

[54] FLUID MOTOR-PUMP UNIT

[75] Inventor: Peter T. McGowan, Fort Lauderdale, Fla.

[73] Assignee: The Garrett Corporation, Los Angeles, Calif.

[21] Appl. No.: 12,913

[22] Filed: Feb. 16, 1979

[51] Int. Cl.[3] ..... F04B 1/16; F04B 17/00; F01L 33/02

[52] U.S. Cl. ..... 417/271; 91/180; 91/503

[58] Field of Search ..... 137/625.15, 625.21; 91/485, 180, 502

[56] References Cited

U.S. PATENT DOCUMENTS

| | | | |
|---|---|---|---|
| Re. 15,756 | 2/1924 | Michell | 123/58 BB |
| 3,369,491 | 2/1968 | Hoffer | 417/271 |
| 3,530,893 | 9/1970 | Masuda | 137/625.21 |
| 3,627,451 | 12/1971 | Rouns | 417/271 |
| 3,823,557 | 7/1974 | Wagenen et al. | 417/269 |
| 4,168,652 | 9/1979 | Rick | 417/271 |

FOREIGN PATENT DOCUMENTS

| | | | |
|---|---|---|---|
| 521510 | 2/1956 | Canada | 91/499 |

*Primary Examiner*—William L. Freeh

*Attorney, Agent, or Firm*—Stuart O. Lowry; Albert J. Miller

[57] ABSTRACT

A fluid motor-pump unit having a circumferentially arranged set of pistons axially reciprocal within a stationary cylinder block, and a rotating valve plate for sequentially porting the pistons between high and low pressure hydraulic ports of an hydraulic system. Apparatus and method are disclosed for dynamically pressure-balancing the rotating valve plate for low friction and low wear operation.

22 Claims, 10 Drawing Figures

Fig. 2.
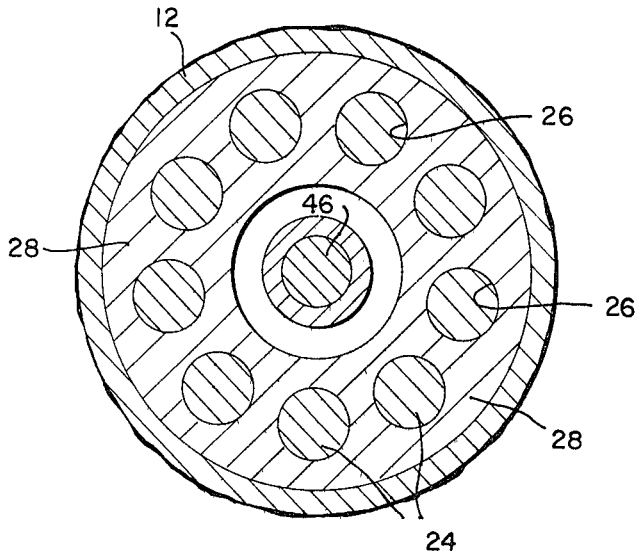
Fig. 5.
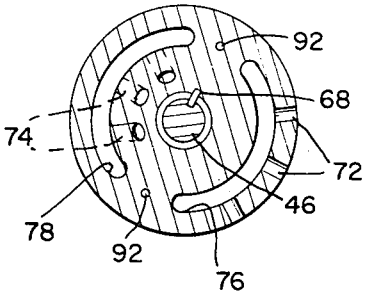
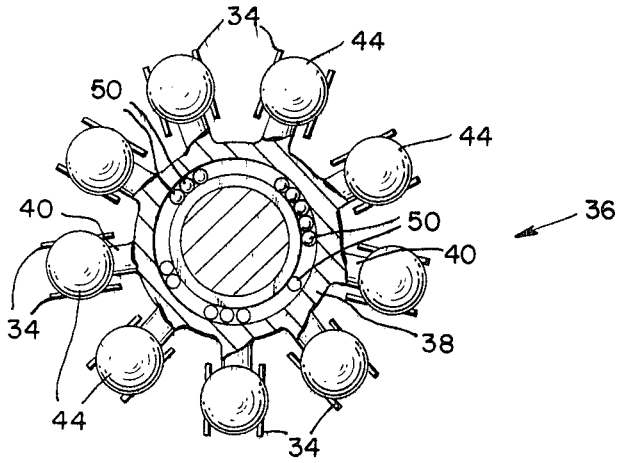
Fig. 3.

FLUID MOTOR-PUMP UNIT

BACKGROUND OF THE INVENTION

This invention relates to fluid motor-pump units. More specifically, this invention relates to an improved hydraulic fluid motor-pump unit having a dynamically pressure-balanced rotating valve plate.

In the prior art, a wide variety of motors, pumps, and other power transfer devices are known for handling fluids such as hydraulic liquids. These devices include, but are not limited to, gear pumps, vane-type pumps, and positive displacement piston pumps such as so-called swash plate pumps. In many applications, positive displacement swash plate pumps are preferred, and include a circumferentially arranged set of axially oriented pistons reciprocally driven to move fluid between high and low pressure hydraulic ports. See, for example, U.S. Pat. Nos. 2,762,307; 2,876,704; 3,613,511; and 4,095,421. These piston pumps are desirable because of their relatively rapid responsiveness and high efficiency at relatively high pumping speeds and pressures, making them particularly suited for use with modern aerospace hydraulic systems. Of course, these devices are usable in either a motor or pump mode, depending upon whether power is being transferred to or from the hydraulic system.

In typical prior art swash plate piston pumps, the circumferentially arranged pistons are received in a matingly configured cylinder block with a valve plate interposed between the cylinder block, and the high and low pressure hydraulic ports. In operation, either the valve plate or the cylinder block wth pistons must be rotated to sequentially port the fluid transferred by the reciprocating pistons between the high and low pressure ports. See U.S. Pat. Nos. 2,661,701; 2,876,704; 3,073,254; 3,238,888; 3,747,476 and 4,095,921 for examples of units with rotating cylinder blocks and stationary valve plates, and U.S. Pat. Nos. 2,762,307 and 3,613,511 for examples of units with stationary cylinder blocks and rotating valve plates.

These prior art swash plate piston pumps include inherent design limitations which limit the efficiency and speed range of the pumps, and thereby also limits their utility. For example, in units having a rotating cylinder block, substantial energy is required to overcome internal friction in order for the components to rotate, particularly upon start-up of the unit. Moreover, centrifugal forces and force imbalances resulting from rotation of the reciprocating pistons further increases internal pump friction and vibrations. These frictional and vibrational factors all contribute to limit undesirably the efficiency and speed range of the unit.

Another inherent design problem relates to the provision of a satisfactory seal between the valve plate and the cylinder block, regardless of which component is rotating. That is, relative rotation between the valve plate and the cylinder block must be relatively leak-free to prevent losses in efficiency, but still guard against excessive friction or wear between the components. However, sealing concepts in the prior art typically have used simple seal rings or gaskets which are not satisfactorily wear-resistant, or clamping springs which supply relatively large spring forces for urging the cylinder block and valve plate into sealing alignment. Such clamping springs contribute to high component wear, as well as to increased internal pump friction to substantially decrease operating range.

Some attempts have been made to statically pressure-balance a nonrotating valve plate of a piston pump in order to provide a leak-free and relatively low friction seal between the valve plate and the cylinder block, and thereby eliminate the use of large clamping springs. Specifically, these designs comprise the provision of axial valve plate openings, and pressure-balancing pistons for equalizing fluid pressures on opposite sides of the stationary valve plate. However, static pressure-balancing techniques are limited to use with nonrotating valve plates. Accordingly, the pressure-balanced plate is necessarily aligned with a rotating cylinder block and pistons which includes the substantial friction and efficiency losses described above due to cylinder block and piston rotation.

In some applications, it is desirable to transfer power from one hydraulic system to another. This is particularly true with aircraft control systems, such as flap actuator systems, wherein alternate and/or standby hydraulic control power is required. Positive displacement swash plate piston pumps have been used in power transfer units by connecting two pump units back-to-back with aligned and connected sets of pistons. One of the pumps is hydraulically operated in a motor mode to drive the other pump in a pump mode, and thereby transfer power from one hydraulic system to another. Some of these power transfer units have been designed with back-to-back rotating cylinder blocks, and thus include relatively high internal friction and efficiency losses resulting from cylinder block and piston rotation. See, for example, U.S. Pat. No. 1,019,521. Other designs utilize stationary cylinder blocks and rotating valve plates, such as those shown in U.S. Pat. Nos. 2,845,030 and U.S. Pat. No. 15,756. However, none of these prior art power transfer unit designs have overcome the problem of providing an adequate seal between valve plates and cylinder blocks without rapid or high wear, or without the use of relatively large clamping forces.

The fluid motor-pump unit of this invention overcomes the problems and disadvantages of the prior art by providing an improved power transfer unit having a stationary cylinder block and a rotating valve plate, wherein the rotating valve plate is dynamically pressure-balanced for relatively low friction, low wear, and minimum leakage operation.

SUMMARY OF THE INVENTION

In accordance with one embodiment of the invention, a pair of circumferentially arranged sets of reciprocating pistons are connected back-to-back and axially received within aligned cylinders formed in opposed stationary cylinder blocks. The two sets of pistons are connected to a nutating spider or swash plate assembly which converts reciprocal piston motion to rotary motion, and imparts the rotary motion to a central shaft having valve plates mounted at its opposite ends in mating engagement respectively with the cylinder blocks. Each valve plate includes fluid passages communicating between the cylinders of the adjacent cylinder block, and high and low pressure hydraulic fluid ports in a unit housing to port fluid from the low to the high pressure port, or vice versa, of an hydraulic system. In operation, one of the sets of pistons and the associated valve plate operates in a motor mode porting fluid from the high to the low pressure ports of one hydraulic system to reciprocally drive the other set of pistons and valve plate in a pump mode to pump fluid from the low to the high pressure ports of a second hydraulic system, and thereby transfer hydraulic power from one system to another.

Each of the rotating valve plates is dynamically pressure-balanced around its circumference in an axial direction for relatively low friction, substantially leak-free running alignment with the adjacent cylinder block. More specifically, a nonrotating balancing member is disposed adjacent each rotating valve plate opposite the associated cylinder block. The nonrotating balancing member includes at least one fluid-receiving balancing chamber axially aligned with and corresponding to each cylinder of the associated cylinder block. Each balancing chamber is supplied with hydraulic fluid by means of axially formed pressure-balance openings about the circumference of the rotating valve plate whereby each chamber receives hydraulic fluid having the same pressure as the hydraulic fluid directly on the opposite side of the valve plate. Fluid pressure within the chambers urges the balancing member axially toward the rotating valve plate for pressure-balancing the valve plate for substantially leak-free, low friction operation.

In a preferred embodiment of the invention, the valve plates each include radially oriented passages communicating with a radially oriented high pressure fluid port, and generally axially oriented passages communicating with an axially oriented low pressure fluid port. In this configuration, hydraulic fluid in the high pressure port is applied against the nonrotating balancing member and tends to axially displace said member with respect to the adjacent rotating valve plate. To pressure-balance the balancing member, the power transfer unit includes one or more pressure-balancing passages in the unit housing for applying high pressure fluid axially against a shoulder formed on the balancing member so as to urge said member into axially pressure-balanced relation with the adjacent valve plate.

BRIEF DESCRIPTION OF THE DRAWINGS

The accompanying drawings illustrate the invention. In such drawings:

FIG. 2 is a section taken on the line 2—2 of FIG. 1;

FIG. 3 is a section taken on the line 3—3 of FIG. 1;

FIG. 5 is a section taken on the line 5—5 of FIG. 1;

DETAILED DESCRIPTION OF THE PREFERRED EMBODIMENT

Figure 1:
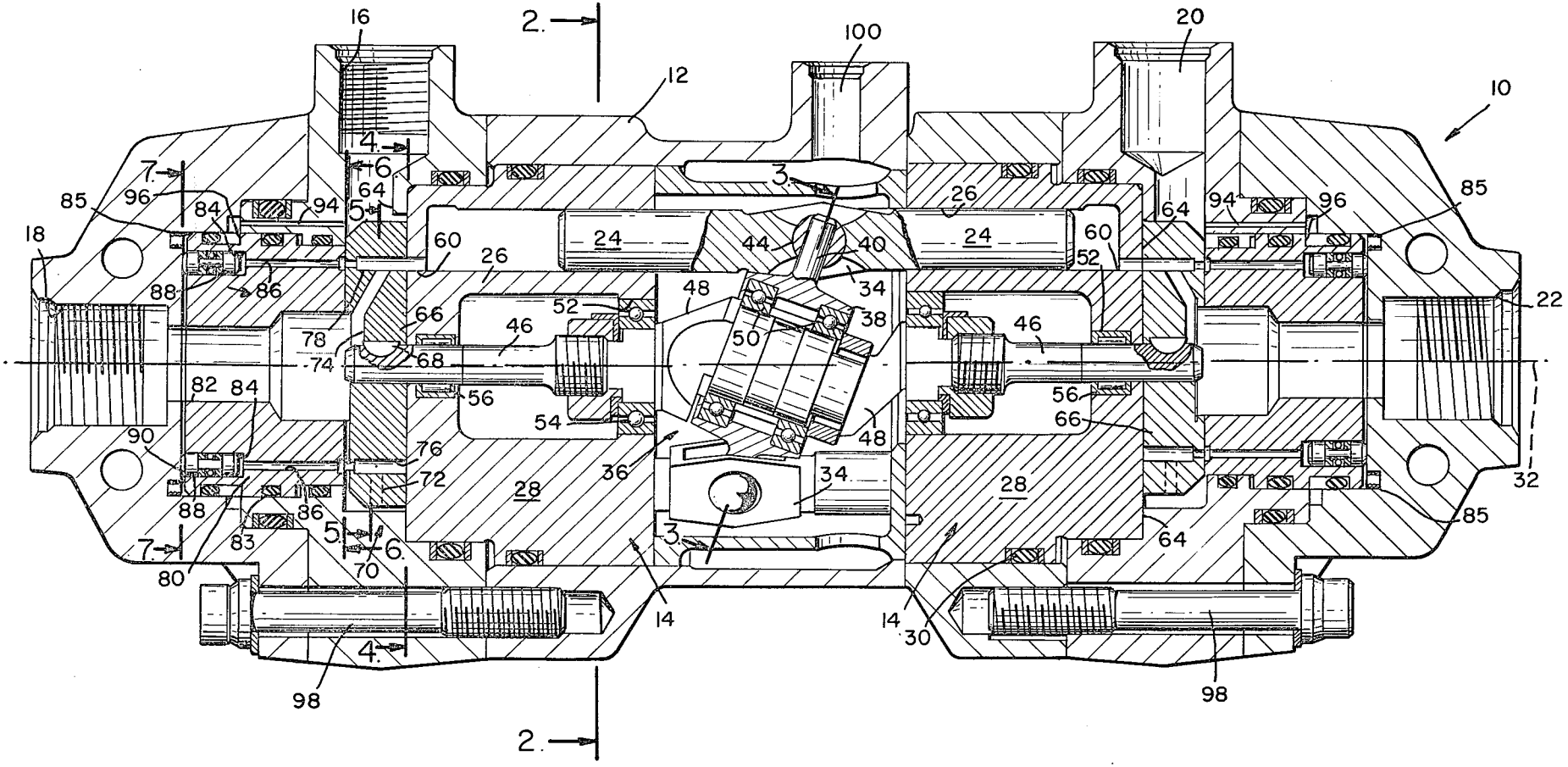
FIG. 1 is a longitudinal vertical section of a fluid motor-pump unit of this invention.

A fluid motor-pump unit 10 of this invention is shown in FIG. 1, and generally comprises a housing 12 carrying a pair of substantially identical motor-pump units or assemblies 14. The two motor-pump assemblies 14 are connected within the housing 12 in a back-to-back relation for simultaneous motion, and are associated respectively with separate and independent hydraulic fluid systems. That is, as shown in FIG. 1, the left-hand one of the motor-pump assemblies 14 is associated with a high pressure port 16 and a low pressure port 18 of a first hydraulic system, and the right-hand one of the motor-pump assemblies is associated with a high pressure port 20 and a low pressure port 22 of a second, independent hydraulic system. In operation, one of the assemblies 14 is operated in a motor mode to port hydraulic fluid from the adjacent high pressure port to the low pressure port, so as to drive the other assembly 14 in a pump mode to pump fluid from the adjacent low pressure port to the high pressure port. In this manner, hydraulic power is transferred from one hydraulic system to another without fluid exchange between the systems.

The two motor-pump assemblies 14 are substantially identical to each other in components and operation, and each includes a set of pistons 24 received in individually aligned bores or cylinders 26 of a cylinder block 28. More specifically, two cylinder blocks 28 are fixedly positioned within the housing 12 generally in opposed relation to each other, with one or more seals 30 being provided to assure mounting of the cylinder blocks 28 within the housing 12 in a nonrotating, leak-free manner.

As shown in FIGS. 1 and 2, each cylinder block 28 includes a plurality of the cylinders 26 extending axially with respect to the housing 12, and arranged circumferentially about a central axis as shown by the dotted line 32. While each of the cylinder blocks 28 is shown including nine circumferentially uniformly arranged and axially extending cylinders 26, no limitation of the invention to any specific number of cylinders is intended. However, the cylinders 26 of the two cylinder blocks 28 correspond in number and are aligned axially with each other.

The pistons 24 are reciprocally received within the cylinders 26 of the cylinder blocks 28, and are connected back-to-back in an axially aligned relationship. Each piston 24 of one cylinder block extends outwardly from the cylinder 26 for connection as by a fork 34 to an axially aligned piston 24 of the other cylinder block. With this construction, the pistons 24 of the two cylinder blocks 28 are connected to form twin piston assemblies for opposite stroking motion during operation of the motor-pump unit. That is, when one piston 24 of each connected pair of pistons is withdrawn to draw hydraulic fluid into the associated cylinder, the other piston 24 of the connected pair is axially moved to discharge hydraulic fluid from its associated cylinder, as will be hereafter described in more detail.

The connected pairs of pistons 24 are all coupled to a central nutating swash plate or spider assembly 36 which sequentially reciprocates the sets of pistons 24 through continuous intake and discharge strokes. More specifically, as shown best in FIGS. 1 and 3, the spider assembly 36 comprises a hollow cylindrical sleeve 38 having a number of radially outwardly projecting spokes 40. The number of spokes 40 correspond in number to the number of connected pairs of pistons 24, and are circumferentially arranged each for reception within the fork 34 of a connected piston pair. The spokes 40 are pivotally connected to the piston pairs by suitable bearing members 44 movably received in the forks 34.

The hollow sleeve 38 is angularly set centrally within the housing 12 between the opposed cylinder blocks 28 and carried on a central shaft 46. This shaft extends axially within the housing 12 along the central axis 32, and includes a central portion 48 which is angularly or eccentrically skewed with respect to the axis 32. The spider assembly sleeve 38 is rotatably carried about the central portion 48 on the shaft 46 as by sets of suitable bearings 50, with the specific type of bearing 50 depending upon design load factors for the unit. With this construction, reciprocal motion of the spokes 40 upon reciprocation of the pistons 24 causes the sleeve 38 to angularly shift within the housing 12, and thereby rotate the central portion 48 of the shaft 46 with respect to the central axis 32. Such rotation of the central portion 48 of the shaft 46 causes corresponding rotation of the remainder of the shaft, and thereby effectively converts reciprocal motion of the pistons 24 to rotational motion of the shaft 46.

The shaft 46 extends axially within the housing through central openings 52 in the opposed cylinder blocks 28. These central openings 52 carry bearings such as, for example, ball bearings 54 and needle bearings 56 which axially and rotationally support the shaft 46. Seals 58 are provided for sealing passage of the shaft 46 through opposite ends of the cylinder blocks 28, and thereby isolate the central portion of the housing and the nutating spider assembly 36 from fluid communication with the hydraulic systems.

Figure 4:
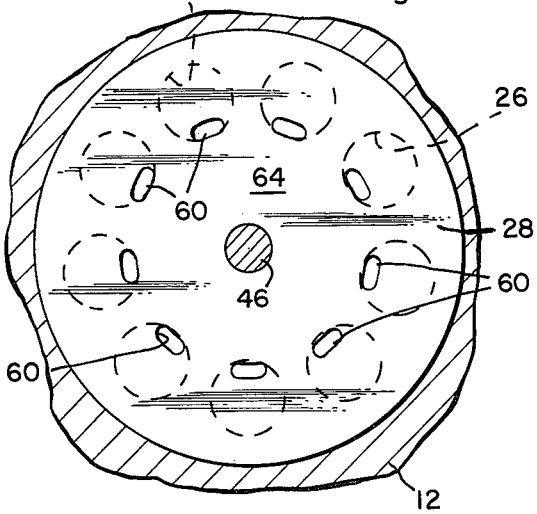
FIG. 4 is a section taken on the line 4—4 of FIG. 1.

As shown in FIG. 4, each cylinder block 28 includes a plurality of generally kidney-shaped ports 60 communicating with the associated cylinders 26. These ports 60 in each cylinder block 28 are arranged in a circular pattern at the end face 64 of the cylinder block, and function as intake and discharge ports upon reciprocation of the pistons 24. These intake and discharge ports 60 are sequentially communicated with the high and low pressure hydraulic ports of the adjacent hydraulic system by means of a dynamically pressure-balanced rotating valve plate 66 disposed in mating and sealing running alignment with the end face 64 of the cylinder block 28. This valve plate 66, as shown in FIGS. 1 and 5, comprises a disk-shaped plate secured on the end of the shaft 46 as by a key 68, and is rotatable along with the shaft 46 to sequentially fluid-couple the circularly-arranged set of cylinder block ports 60 between the adjacent high and low pressure hydraulic system ports.

In the embodiment of the invention shown, the high pressure hydraulic system ports 16 and 20 at opposite ends of the unit 10 are radially oriented for radial admission of high pressure hydraulic fluid into a radially enlarged volume 70 circumferentially surrounding the adjacent valve plate 66. Moreover, the low pressure hydraulic system ports 18 and 22 at opposite ends of the unit are axially oriented generally along the central axis 32 for axial communication between these ports 18 and 22 with the adjacent valve plate 66. In this regard, each of the valve plates 66 includes a plurality of radially outwardly directed flow passages 72 for communication with the high pressure radial volume 70, and a plurality of generally radially inwardly and axially outwardly angled flow passages 74 for communication with the adjacent low pressure hydraulic port. Importantly, as shown in FIGS. 1 and 5, the high pressure flow passages 72 and the low pressure flow passages 74 are formed generally within opposite halves of the circumference of each valve plate 66.

The high pressure flow passages 72 form flow paths for high pressure hydraulic fluid between the high pressure volume 70 and a generally arcuately formed high pressure valve port 76. The valve port 73 is formed axially through the valve plate 66 on a radius generally corresponding with the radius of the kidney-shaped ports 60 on the adjacent cylinder block 28. As shown, the high pressure valve port 76 extends arcuately over a substantial portion of one-half of the circumference of the valve plate, say about 160°. In operation, the valve port 76 serves to fluid-couple the high pressure fluid with the kidney-shaped cylinder block ports 60, with the specific ports 60 coupled to high pressure fluid depending upon the position of rotation of the valve plate 66. Thus, rotation of the valve plate 66 continuously and sequentially couples the cylinders 26 of the adjacent cylinder block 28 to the high pressure fluid.

The low pressure flow passages 74 in the valve plate 66 form flow paths for low pressure hydraulic fluid between the adjacent low pressure port 18 or 22, and a generally arcuately formed low pressure valve port 78. This low pressure valve port 78 is also formed axially through the valve plate 66, and on a radius generally corresponding with the radius of the adjacent cylinder block ports 60. As shown, the low pressure valve port 78 extends arcuately over slightly less than one-half of the valve plate circumference, again about 160°, and generally in opposed relation with the high pressure valve port 76. In operation, the low pressure valve port 78 fluid-couples the low pressure fluid with the cylinder block ports 60, with the specific ports 60 coupled to the low pressure fluid depending upon the position of rotation of the valve plate 66. Thus, rotation of the valve plate 66 continuously and sequentially couples some of the adjacent set of pistons 24 and cylinders 26 to high pressure fluid and others to low pressure fluid. This causes the pistons 24 coupled to high and low pressure fluid, respectively to, undergo opposite stroking motion which in turn causes a continuous nutation of the spider assembly 36 to rotate the valve plate 66 and to reciprocally drive the other set of pistons 24 of the other motor-pump assembly 14.

As shown in FIG. 1, a pressure-balancing member 80 is positioned against each valve plate 66, and operates to dynamically pressure-balance axial forces acting upon the valve plate 66 during operation. More specifically, the pressure-balancing member 80 comprises a generally cylindrical insert received within the housing 12, and including an axial passage 82 aligned with the adjacent low pressure port 18 or 22 for allowing open fluid flow between the low pressure port and the adjacent valve plate 66. Seals 83 are provided for preventing fluid leakage around the balancing member 80 and to secure said member within the housing 12 in a nonrotating manner. Small springs 85 pre-load the balancing member 80 into relatively light pressure contact with the adjacent valve plate 66 to assure proper initial alignment of the components upon start-up of operation.

Figure 6:
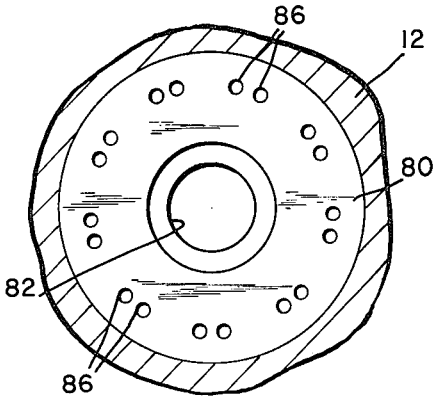
FIG. 6 is a fragmented section taken on the line 6—6 of FIG. 1.

The pressure-balancing member 80 includes a plurality of balancing chambers 84 communicating with the high and low pressure valve ports 76 and 78 of the adjacent valve plate 66. As shown by way of the preferred embodiment of FIGS. 6 and 7, two of these balancing chambers 84 are provided for and generally axially aligned with each kidney-shaped port 60 of each cylinder 26 in the adjacent cylinder block 28, although any number of chambers 84 per port 60 may be provided depending upon the specific balancing characteristics desired. Each balancing chamber 84 communicates with the valve ports 76 and 78 through an orifice passage 86, and thus the balancing member 80 receives either high or low pressure hydraulic fluid according to the rotational position of the valve plate 66. Each chamber 84 includes fluid sealing means in the form of a balancing piston 88 received within the chamber 84 to prevent leakage therefrom, and to react against the end wall 90 of the unit housing 12 when fluid under pressure is received in the chamber. Thus, the fluid under pressure within the balancing chambers 84 urges the balancing member 80 axially against the rotating valve plate 66 with circumferentially incremental and axially directed balancing forces corresponding with hydraulic fluid pressures on the axially opposite side of the valve plate 66. In this manner, the valve plate 66 is dynamically pressure-balanced with an hydraulic balanced pressure seal in a substantially leak-free, low friction manner between the cylinder block end face 64 and the balancing member 80. That is, regardless of the position of rotation of the valve plate 66, circumferential portions of the valve plate 66 exposed to relatively high fluid pressures are pressure-balanced on opposite sides with equalizing reaction forces, and other portions of the valve plate 66 exposed to lower magnitudes of fluid pressures are pressure-balanced on opposite sides with corresponding equalizing reaction forces.

Figure 7:
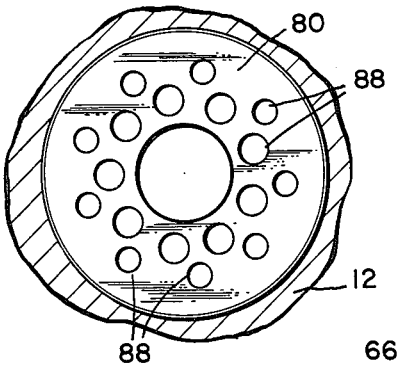
FIG. 7 is a fragmented section taken on the line 7—7 of FIG. 1.

The cross-sectional areas of the balancing chambers 84 are carefully predetermined so as to apply the correct reaction forces to the balancing member 80 and the valve plate 66. In this regard, as illustrated in FIG. 7, the balancing chambers 84 may be radially staggered to allow a maximum number of balancing chambers 84 within a minimum-sized balancing member 80. As shown, some of the balancing chambers 84 are staggered radially inwardly, and have a relatively enlarged cross-sectional area when compared with the radially outwardly disposed balancing chambers 84. However, all of the chambers 84 have a cross-sectional area predetermined to provide the desired force moment with respect to the central axis 32, and thereby provide the desired balancing force effect upon the valve plate 66.

Figure 8:
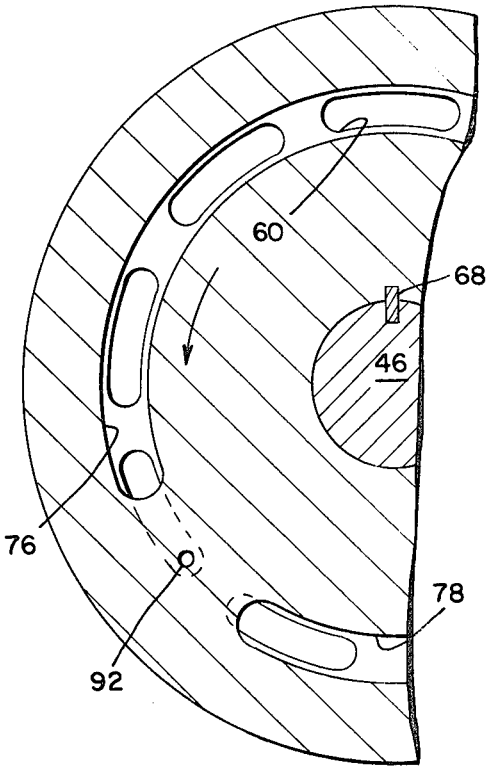
FIG. 8 is an enlarged fragmented section of a portion of the unit illustrating the operation thereof.
Figure 9:
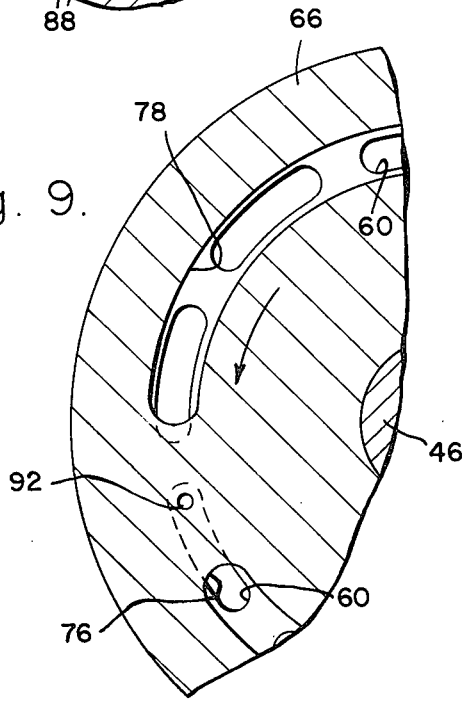
FIG. 9 is an enlarged fragmented vertical section similar to FIG. 8 illustrating further the operation of the invention.

As shown in FIGS. 8 and 9, the valve plates 66 include valve orifices 92 radially separating the high and low pressure valve ports 76 and 78 for improving the balancing characteristics of the unit. In particular, the high and low pressure valve ports 76 and 78 are desirably separated at each end by arcuate distance equaling or exceeding the arcuate length of one of the kidney-shaped cylinder block ports 60. This prevents both high and low pressure valve ports 76 and 78 from simultaneously coupling hydraulic fluid to the same cylinder 26. However, since two of the balancing member orifice passages 86 are aligned with each kidney-shaped port 60, the valve plate orifice 92 allows both orifice passages 86 to receive pressurized fluid upon initial rotational alignment between either the high or low pressure port 76 or 78 and the cylinder block port 60. That is, as shown by way of example in FIGS. 8 and 9, as the high pressure port 76 rotates to initially supply fluid to a cylinder 26 via one of the kidney-shaped ports 60, the valve port 76 also inherently overlaps one of the two balancing orifice passages 86 (not shown in FIG. 8) aligned with that port 60 to allow fluid supply to the orifice passage 86. The high pressure fluid within the cylinder 26 also is supplied to the second balancing orifice passage 86 (also not shown in FIG. 8) aligned with that port 60 by means of a leakage path provided by the valve plate orifice 92 in order to fully pressure-balance the valve plate 66. This occurs both upon initial fluid-coupling between the valve port 76 and a cylinder block port 60, as shown in FIG. 8, as well as upon final rotational alignment between the valve port 76 and cylinder block port 60 as shown in FIG. 9. Thus, the valve plate orifice 92 allows both balancing chambers 84 of the balancing member 80 aligned with one of the ports 60 to fill with fluid to pressure-balance the valve plate 66 even when the valve port 76 is only partially aligned with the cylinder block port 60. Of course, the diametrically opposite valve orifice 92 functions in the same manner with respect to the low pressure valve port 78 to provide close dynamic pressure-balancing around the circumference of the valve plate.

In the embodiment shown, the high pressure fluid within the high pressure hydraulic system ports 16 and/or 20 circumferentially surrounds the valve plate 66 within the radial volume 70. This presence of high pressure fluid tends to axially displace each pressure-balancing member 80 away from the adjacent valve plate 66 potentially resulting in leakage between the components. To overcome this potential leakage, as shown in FIG. 1, the unit housing 12 includes one or more secondary balancing orifices 94 communicating with the radial volume 70. This orifice 94 ducts high pressure hydraulic fluid into communication with a relatively small radially projecting shoulder 96 on the balancing member 80 to axially urge the balancing member 80 back toward the valve plate 66 to counteract any leakage tendency. Importantly, the effective cross-sectional area of this shoulder 96 is carefully predetermined to axially pressure-balance the balancing member 80, and thereby control or prevent undesirable leakage.

In operation of the unit, one hydraulic system is used to operate one of the motor-pump assemblies 14 in a motor mode for driving the other motor-pump assembly 14 in a pump mode, and thereby transfer hydraulic power between the two hydraulic systems without fluid exchange therebetween. Specifically, by way of example, high pressure fluid is supplied via the high pressure system port 16 to one end of the unit. The high pressure fluid is ported via the valve plate 66 to some of the cylinders 26 of the adjacent cylinder block 28. The valve plate 66 and the pistons 24 within the cylinders 26 are formed so that the high pressure fluid causes retraction of the pistons 24 to draw the fluid into the cylinders 26. This causes the remaining pistons 24 of the set to sequentially begin to discharge fluid to the low pressure system port 18 as governed by the nutating spider assembly 36, as well as to rotate the central shaft 46.

Shaft rotation serves to rotate the valve plate 66 to continue sequential reciprocation of the pistons 24. Simultaneously, the pistons 24 within the other cylinder block 28 are moved through an opposite and continuous stroke sequence to draw in and discharge hydraulic fluid of the other hydraulic system. However, since the first motor-pump assembly is operating in the motor mode to move fluid from the high pressure port 16 to the low pressure port 18, the second motor-pump assembly operates in a pump mode to draw in fluid from the low pressure system port 22 and discharge the fluid under pressure to the high pressure system port 20. Importantly, the two valve plates 66 are keyed to the shaft 46 in angular alignment, or in phase with each other, whereby the two pump assemblies 14 always operate in opposite modes.

The fluid motor-pump unit 10 of this invention offers significant advantages over units of the prior art. By eliminating frictional resistances and imbalances attendant with rotating cylinder blocks and pistons, and large clamping springs, this invention provides a unit with extremely low start-up or break-out friction for excellent wear and operational characteristics at both low and high rotational speeds and throughout a wide range of fluid pressures. Moreover, as illustrated in FIG. 1, the housing 12 may be formed from several sections connected together as by bolts 98 for easy assembly. Lubrication ports 100 may also be provided for providing controlled lubrication to the rotating shaft 46, spider assembly 36, and the like.

Figure 10:
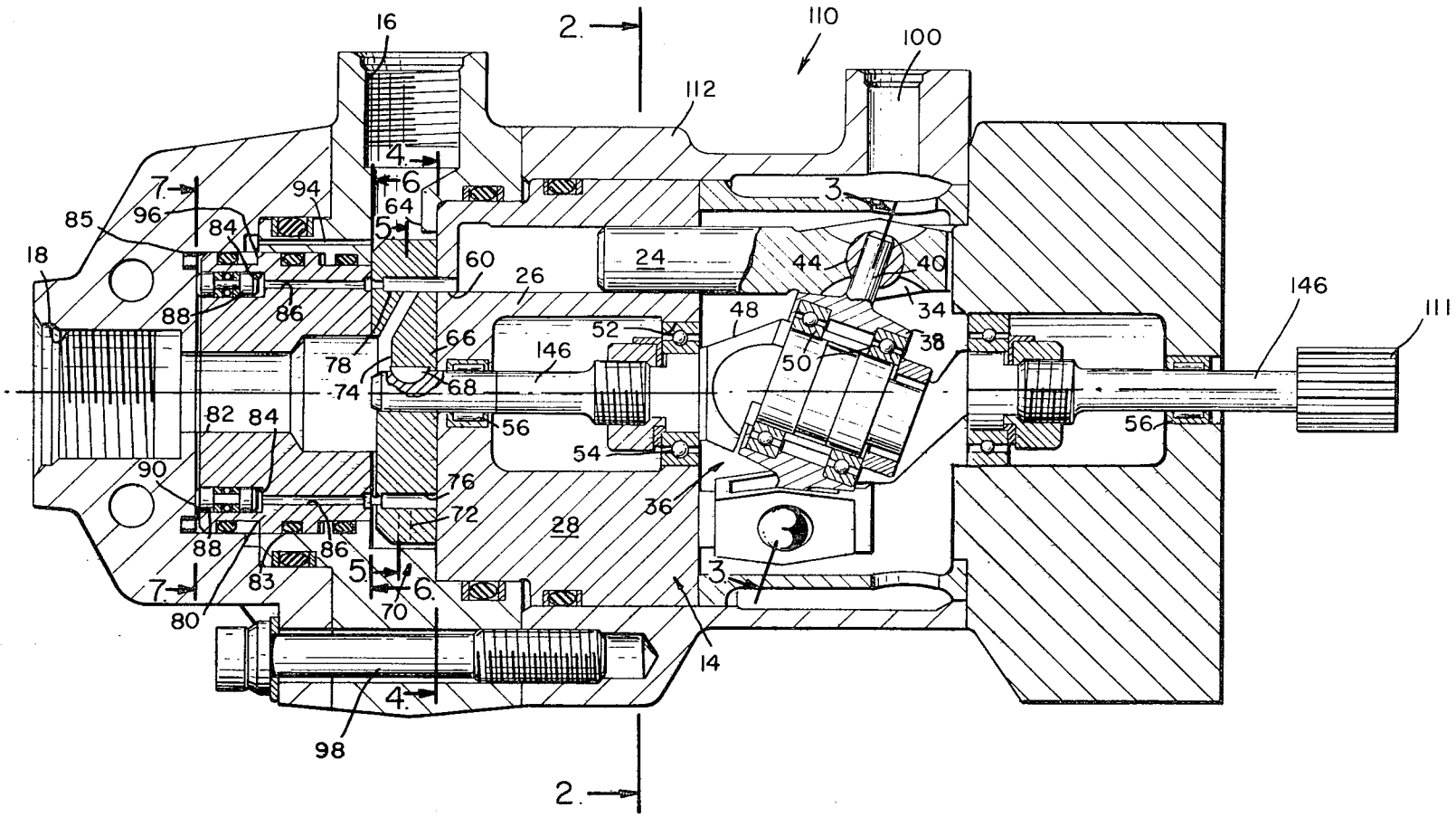
FIG. 10 is a longitudinal vertical section of an alternate embodiment of the invention.

A modified embodiment of the invention is shown in FIG. 10, with like reference numerals referring to portions common with the embodiment of FIGS. 1–9. As shown, a modified fluid motor-pump unit 110 is provided for coupling power between a gear 111 on a shaft 146, and an hydraulic system by means of high and low pressure hydraulic systems ports 16 and 18. The modified unit 110 includes a housing 112 in which is mounted a single motor-pump assembly 14. The motor-pump assembly 14 comprises a stationary cylinder block 28 including a circumferentially arranged set of cylinders 26 in which are received axially reciprocal pistons 24. The pistons 24 are coupled as by integrally formed forks 34 to spokes 40 of a central nutating swash plate or spider assembly 36 which responds to piston reciprocation to rotationally drive the central shaft 146.

Rotation of the shaft 146 rotationally drives a valve plate 66 which ports hydraulic fluid between the high and low pressure system ports 16 and 18 by means of high and low pressure valve ports 76 and 78. Importantly, as in the previous embodiment, the valve plate 66 is dynamically pressure-balanced by a pressure balancing member 80 including balancing chambers 84 and pistons 88, and orifice passages 86. Moreover, secondary balancing is achieved by means of a secondary balance orifice 94 in the housing 112 to provide fluid reacting against a shoulder 96 on the balancing member 80.

The embodiment of FIG. 10 may be operated in either a pump or motor mode. For example, in a motor mode, hydraulic fluid is ported from the high pressure system port 16 to the low pressure system port 18 to reciprocate the pistons 24 and rotate the shaft 146. This rotates the valve plate 66 and the gear 111 whereby the gear 111 may provide a suitable driving source for rotational machinery (not shown). Alternately, the gear 111 may be suitably driven to operate the unit in a pump mode. For example, rotational driving of the gear 111 drives the shaft 146 to reciprocate the pistons 24 and rotate the valve plate 66. In this manner, hydraulic fluid is pumped by the pistons 24 from the low pressure system port 18 to the high pressure system port 16.

A wide variety of further modifications and improvements of the invention are believed to be possible and apparent in view of the embodiments described herein. For example, the opposed motor-pump assemblies 14 of the embodiment of FIG. 1 may be formed to have respective sets of pistons 24 wherein the pistons have different cross-sectional diameters. In this manner, the power transfer unit 10 may be used as a pressure intensifier or pressure reducer for transferring power in either direction between hydraulic systems having different pressure fluid levels. Accordingly, no limitation of the invention is intended by way of the description herein except as set forth in the appended claims.

What is claimed is:

1. A fluid motor-pump assembly for transferring power between first and second hydraulic fluid systems, comprising a housing having first high and low pressure ports coupled to said first hydraulic fluid system and second high and low pressure ports coupled to said second hydraulic fluid system; a first motor-pump unit for moving fluid from said first high pressure port to said first low pressure port, and a second motor-pump unit driven by said first motor-pump unit for pumping fluid from said second low pressure port to said second high pressure port, said first and second motor-pump units each comprising a cylinder block rotatably fixed within said housing having a plurality of axially extending cylinders formed therein each receiving a reciprocal piston and including a cylinder block port for communication with the associated high and low pressure ports, a central rotatable shaft within said housing with said cylinders circumferentially arranged with respect thereto, means coupled between said shaft and said pistons for converting between rotational and reciprocal motion, a valve plate rotatable with the shaft in running alignment with said cylinder block and between the associated high and low pressure ports, said valve plate including valve ports for sequentially communicating said cyclinder block ports respectively with the associated high and low pressure ports upon shaft rotation, and a pressure-balancing member rotatably fixed within said housing in running alignment with said valve plate opposite said cylinder block and including a plurality of means generally aligned axially with respective ones of said cylinder block ports and each responsive to fluid pressure at its associated cylinder block port for urging said member axially against said valve plate for dynamically pressure-balancing axial forces applied to said valve plate regardless of the position of valve plate rotation, said plurality of means of each of said first and second motor-pump units includes a plurality of circumferentially arranged, generally axially extending fluid passages formed in said pressure-balancing member for communicating with said cylinder block ports through said valve ports upon valve plate rotation for receiving fluid under pressure whereby the fluid pressure within each said passage corresponds with the fluid pressure on the opposite side of said valve plate regardless of valve plate rotational position, each of said passages comprising a relatively small orifice passage for communicating with said valve ports, and a relatively enlarged cylinder, said relatively enlarged cylinders formed within said pressure-balancing member being radially staggered with respect to each other, radially inwardly staggered ones of said balancing member cylinders being formed to have a diameter relatively larger than radially outwardly staggered ones of said balancing member cylinders, and including fluid sealing means for sealing said passages and for engaging said housing for pressure-reacting against said housing to urge said member axially toward said valve plate, said fluid sealing means comprising a plurality of sealing pistons respectively received within said passages; said means for converting between rotational and reciprocal motion being common to said first and second motor-pump units whereby said second motor-pump unit is drivingly operated by said first motor-pump unit for power transfer therebetween, said valve plates of said first and second motor-pump units being mounted on their respective shafts generally in phase with each other.

2. A reversible fluid motor-pump assembly for transferring power between first and second hydraulic fluid systems, comprising a housing having first high and low pressure ports coupled to said first hydraulic fluid system and second high and low pressure ports coupled to said second hydraulic fluid system; a first motor-pump unit for moving fluid from said first high pressure port to said first low pressure port, and a second motor-pump unit for pumping fluid from said second low pressure pump to said second high pressure port, said first and second motor-pump units each comprising a cylinder block disposed against rotation within said housing having a plurality of axially extending cylinders formed therein each receiving a reciprocal piston and including a cylinder block port for communication with the associated high and low pressure ports, a central rotatable shaft within said housing with said cylinders circumferentially arranged with respect thereto, means coupled between said shaft and said pistons for converting between rotational and reciprocal motion, a valve plate rotatable with the shaft in running alignment with said cylinder block and between the associated high and low pressure ports, said valve plate including valve ports for sequentially communicating said cylinder block ports respectively with the associated high and low pressure ports upon shaft rotation, and a pressure-balancing member within said housing in running alignment with said valve plate opposite said cylinder block, said member including a generally circular pattern of generally axially extending fluid passages aligned axially with respective ones of said cylinder block ports for communication with said cylinder block ports through said valve ports upon valve plate rotation for receiving fluid under pressure through said valve ports whereby the fluid pressure within each said passage corresponds with the fluid pressure at its associated cylinder block port regardless of the position of valve plate rotation, each of said passages of each of said first and second motor-pump units comprising a relatively small orifice passage for communicating with said valve ports, and a relatively enlarged cylinder, said relatively enlarged cylinders formed within said pressure-balancing member being radially staggered with respect to each other, radially inwardly staggered ones of said balancing member cylinders being formed to have a diameter relatively larger than radially outwardly staggered ones of said balancing members cylinders, and fluid sealing means for sealing said passages and for pressure-reacting against said housing for urging said balancing member axially toward said valve plate for dynamically pressure-balancing axial forces applied to said valve plate; and means for connecting said first motor-pump unit with said second motor-pump unit for power transfer therebetween whereby the one of said units coupled to the one of said first and second hydraulic fluid systems having the higher fluid pressure drivingly operates the other of said units.

3. A fluid motor-pump assembly as set forth in claim 1 wherein the one of said first and second motor-pump units coupled to the one of said first and second hydraulic fluid systems having the higher fluid pressure comprises said first motor-pump unit for drivingly operating said second motor-pump unit.

4. A fluid motor-pump assembly as set forth in claim 3 wherein said assembly is reversible in response to the fluid pressure level of said first and second hydraulic fluid systems.

5. A fluid motor-pump assembly as set forth in claim 1 or 2 wherein said cylinder block ports in said cylinder block of each of said first and second motor-pump units are formed in a generally circular configuration, said associated valve plate being sized and shaped for covering said cylinder block ports, said valve plate ports being formed in axial alignment with said cylinder block ports.

6. A fluid motor-pump assembly as set forth in claim 1 or 2 wherein said housing forms an expanded volume radially surrounding said valve plate of each of said first and second motor-pump units and communicating with the associated high pressure port.

7. A fluid motor-pump assembly as set forth in claim 1 or 2 wherein said cylinder block ports of each of said first and second motor-pump units are arranged in a generally circular configuration, said associated pressure-balancing member including at least one of said passages in generally axial alignment with each one of said cylinder block ports.

8. A fluid motor-pump assembly as set forth in claim 1 or 2 wherein the associated high pressure port radially communicates with an expanded radial volume formed in said housing and circumferentially surrounding said valve plate, said pressure-balancing members each including axially directed shoulder means opposite said valve plate, and fluid passage means for communicating said shoulder means with fluid under pressure within said volume for axially urging said balancing member against said valve plate in counteraction to fluid pressure within said volume.

9. A fluid motor-pump assembly as set forth in claims 1 or 2 including a plurality of piston assemblies, each of said piston assemblies including a back-to-back connected pair of pistons with one of said pair of pistons received within a cylinder of said first motor-pump unit and the other of said pair of pistons received within a cylinder of said second motor-pump unit whereby reciprocal motion of the pistons of said first motor-pump unit reciprocally drives the pistons of said second motor-pump unit.

10. A fluid motor-pump assembly as set forth in claim 9 wherein said means for converting between rotational and reciprocal motion comprises a swash plate assembly connected to said piston assemblies and plate assembly connected to said piston assemblies and coupled to said shafts of each of said first and second motor-pump units.

11. A fluid motor-pump assembly as set forth in claim 1 or 2 wherein said valve ports of each of said motor-pump units comprise generally opposed first and second axially extending valve ports formed in said valve plate and each extending arcuately over slightly less than one-half the circumference of said valve plate, said valve plate further including radially outwardly oriented flow passages communicating between said first valve port and the associated high pressure port, and generally radially inwardly and axially extending flow passages communicating between said second valve port and the associated low pressure port.

12. A fluid motor-pump assembly as set forth in claim 11 wherein said valve plate of each of said first and second motor-pump units further includes a pair of axially extending valve orifices formed generally in opposite halves of said valve plate on a common radius with said valve ports and generally equidistantly between adjacent valve ports, said pressure-balancing member including at least two of said fluid passages axially aligned with each one of said cylinder block ports for communicating with said valve ports and orifices upon valve plate rotation for receiving fluid under pressure through said valve ports and orifices.

13. A fluid motor-pump assembly for transferring power between fluid systems, comprising a housing having first high and low pressure ports and second high and low pressure ports for respective connection to first and second fluid systems; cylinder block means within said housing forming a pair of generally opposed sets of circumferentially arranged and axially extending cylinders, and forming first and second sets of cylinder block ports for respective communication with said first and second housing pressure ports; a plurality of piston assemblies each including a pair of back-to-back connected pistons reciprocally received respectively within a generally opposed pair of cylinders of said cylinder sets; a central axially extending rotatable shaft within said housing; means coupled between said shaft and said piston assemblies for converting between rotational and reciprocal motion; first and second valve plates on said shaft in running alignment with said cylinder block means generally between respectively said first set of cylinder block ports and said first housing pressure ports, and said second set of cylinder block ports and said second housing pressure ports, each of said valve plates including a pair of valve ports for sequentially communicating said cylinder block ports with the associated housing pressure ports upon shaft rotation; and first and second pressure-balancing members within said housing in running alignment respectively with said first and second valve plates opposite said cylinder block means, said pressure-balancing members each including a generally circular pattern of generally axially extending fluid passages aligned axially with respective ones of said cylinder block ports, each of said passages receiving fluid sealing means responsive to fluid pressure at the associated cylinder block port for urging said member axially against the associated valve plate for dynamically pressure-balancing axial forces applied to said associated valve plate regardless of rotational position thereof, said generally circular pattern of axially extending passages in each of said pressure-balancing members including a plurality of radially staggered passages with radially inwardly staggered ones of said passages having a diameter relatively larger than radially outwardly staggered ones of said passages.

14. A fluid motor-pump assembly as set forth in claim 13 wherein said valve plates are mounted on said shaft for rotation therewith generally in phase with each other whereby each piston assembly has its pair of pistons sequentially coupled in phase with the associated high and low pressure ports.

15. A fluid motor-pump assembly as set forth in claim 13 wherein said valve ports comprise generally opposed first and second axially extending valve ports formed in said valve plate and each extending arcuately over slightly less than one-half the circumference of said valve plate, said valve plate further including radially outwardly oriented flow passages communicating between said first valve port and the associated high pressure port, and generally radially inwardly and axially extending flow passages communicating between said second valve port and the associated low pressure port.

16. A fluid motor-pump assembly as set forth in claim 13 wherein said cylinder block ports in said cylinder block of each of said first and second motor-pump units are formed in a generally circular configuration, said associated valve plate being sized and shaped for covering said cylinder block ports, said valve plate ports being formed in axial alignment with said cylinder block ports.

17. A fluid motor-pump assembly as set forth in claim 13 wherein said fluid sealing means comprises a plurality of sealing pistons respectively received within said passages.

18. A fluid motor-pump assembly as set forth in claim 13 wherein the one of said first and second motor-pump units coupled to the one of said first and second hydraulic fluid systems having the higher fluid pressure comprises said first motor-pump unit for drivingly operating said second motor-pump unit.

19. A fluid motor-pump assembly as set forth in claim 13 wherein said means for converting between rotational and reciprocal motion comprises a swash plate assembly connected to said piston assemblies and coupled to said shafts of each of said first and second motor-pump units.

20. A fluid motor-pump assembly as set forth in claim 19 wherein said valve plate porst are arcuately spaced from each other by an arcuate distance at least exceeding the arcuate length of one of said cylinder block ports.

21. A fluid motor-pump assembly as set forth in claim 13 wherein each of said valve plates further includes a pair of axially extending valve orifices formed generally in opposite halves of said valve plate on a common radius with said valve ports and generally equidistantly between adjacent valve ports, each of said pressure-balancing members including at least two of said fluid passages axially aligned with each one of said cylinder block ports for communicating with said valve ports and orifices upon valve plate rotation for receiving fluid under pressure through said valve ports and orifices.

22. A fluid motor-pump assembly as set forth in claim 19 wherein each of said passages comprises a relatively small orifice passage for communicating with said valve ports, and a relatively enlarged cylinder for receiving the associated sealing piston.

* * * * *

UNITED STATES PATENT AND TRADEMARK OFFICE

CERTIFICATE OF CORRECTION

PATENT NO. : 4,297,086

DATED : October 27, 1981

INVENTOR(S) : PETER T. McGOWAN

It is certified that error appears in the above–identified patent and that said Letters Patent are hereby corrected as shown below:

Column 12, lines 45 and 46, delete "plate assembly connected to said piston assemblies and";

Column 14, line 34, change "19" to --21--;

change "porst" to --ports--.

Signed and Sealed this

*Fifth* Day of *January 1982*

[SEAL]

*Attest:*

*Attesting Officer*

GERALD J. MOSSINGHOFF

*Commissioner of Patents and Trademarks*